US012140407B2

(12) United States Patent
Eilat

(10) Patent No.: US 12,140,407 B2
(45) Date of Patent: Nov. 12, 2024

(54) DEFLECTION ELEMENT AND PROTECTIVE SUIT USING THE DEFLECTION ELEMENT

(71) Applicants: ISRAEL WEAPON INDUSTRIES (I.W.I) LTD., Kiryat-Gat (IL); Dakar Eilat, Sde Nahum (IL)

(72) Inventor: Dakar Eilat, Sde Nahum (IL)

(73) Assignees: Dakar Eilat, Sde Nahum (IL); ISRAEL WEAPON INDUSTRIES (I.W.I) LTD., Kiryat Gat (IL)

( * ) Notice: Subject to any disclaimer, the term of this patent is extended or adjusted under 35 U.S.C. 154(b) by 0 days.

(21) Appl. No.: 18/696,370

(22) PCT Filed: Sep. 5, 2022

(86) PCT No.: PCT/IL2022/050964
§ 371 (c)(1),
(2) Date: Mar. 28, 2024

(87) PCT Pub. No.: WO2023/058012
PCT Pub. Date: Apr. 13, 2023

(65) Prior Publication Data

US 2024/0337469 A1 Oct. 10, 2024

(30) Foreign Application Priority Data

Oct. 6, 2021 (IL) ..... 287023

(51) Int. Cl.
*A41D 31/24* (2019.01)
*A41D 31/28* (2019.01)
*F41H 1/02* (2006.01)

(52) U.S. Cl.
CPC ..... *F41H 1/02* (2013.01); *A41D 31/245* (2019.02); *A41D 31/285* (2019.02)

(58) Field of Classification Search
CPC .... A41D 13/06; A41D 31/245; A41D 31/285; A42B 3/063; F41H 1/02
See application file for complete search history.

(56) References Cited

U.S. PATENT DOCUMENTS 4,561,123 A * 12/1985 Hull ..... A41D 13/065 2/24
5,329,638 A * 7/1994 Hansen ..... A41D 13/088 2/16

(Continued)

FOREIGN PATENT DOCUMENTS

CN 105627826 6/2016
WO WO-2004032659 A1 * 4/2004 ..... A42B 3/064
WO WO-2008046196 A1 * 4/2008 ..... A42B 3/0473

OTHER PUBLICATIONS

Ballistic protection performance of curved armor systems with or without debondings/delaminations: Materials & Design, 64, 25-34 Ping Tan Jul. 14, 2014 (Jul. 14, 2014).

*Primary Examiner* — Tajash D Patel
(74) *Attorney, Agent, or Firm* — SOROKER AGMON NORDMAN RIBA

(57) ABSTRACT

A deflection element and a protective suit incorporating such are provided. The deflection element including an upper arc; and a lower arc, wherein each of the upper arc and the lower arc include a solid flexible arc shaped layer, a soft padding layer on an inner side of the upper arc and on a matching side of the lower arc, a material forming an encasement around the solid arc shaped layer and the soft padding layer; and wherein the encasement of the upper arc at each end is connected to the encasement of the lower arc with the inner side of the upper arc facing the lower arc.

20 Claims, 13 Drawing Sheets

(56) References Cited

U.S. PATENT DOCUMENTS

| | | | | |
|---|---|---|---|---|
| 5,459,878 | A | 10/1995 | Gold | |
| 5,581,805 | A | 12/1996 | Rennick | |
| 6,032,300 | A * | 3/2000 | Bainbridge | A41D 31/28 5/655.4 |
| 7,571,493 | B1 | 8/2009 | Purvis et al. | |
| 7,712,150 | B2 * | 5/2010 | Pardillo | A41D 13/0556 2/23 |
| 8,087,101 | B2 * | 1/2012 | Ferguson | A41D 31/285 2/455 |
| 8,214,929 | B2 * | 7/2012 | Kraemer | A63B 71/12 2/459 |
| 8,732,868 | B2 * | 5/2014 | Ellis | A43B 7/1445 2/414 |
| 8,875,319 | B2 * | 11/2014 | Martin | A41D 13/015 2/459 |
| 8,959,671 | B1 | 2/2015 | Mandak | |
| 9,067,122 | B2 | 6/2015 | Diamond | |
| 11,963,570 | B2 * | 4/2024 | Pietrzak | A42B 3/064 |
| 2014/0087104 | A1 | 3/2014 | Kierderle | |
| 2014/0304900 | A1 * | 10/2014 | Sugano | A41D 13/0575 2/455 |
| 2018/0292177 | A1 | 10/2018 | Roby | |
| 2020/0154803 | A1 | 5/2020 | Goulet | |

* cited by examiner

DEFLECTION ELEMENT AND PROTECTIVE SUIT USING THE DEFLECTION ELEMENT

FIELD OF THE DISCLOSURE

The present disclosure relates to a protective suit for law enforcement officers and other users and more specifically to a protective suit that comprises deflection elements to deflect attacking forces.

BACKGROUND OF THE DISCLOSURE

Law enforcement officers may wear protective gear to protect them from attacks, since they may be subject to conditions when they are shot at, stabbed or receive blows from attackers. The protective gear for each type of attack may differ. Thus, the user might be required to select different gear against blows, knives or bullets, depending on the expected threat.

Likewise, motorcycle users or users of other unprotected vehicles may also benefit from wearing protective gear to protect them from impact. Athletes may also benefit from the use of protective gear.

Typically, the protective gear may include a rigid outer layer to absorb the blow and a soft inner layer to soften the blow received by the user. For example, a 5.56 mm bullet delivers about 2000 joules to a point with a diameter of 5 mm. The protective gear outer layer aims to stop the bullet and cushion the blow with the aid of the inner layer. Likewise, a baseball bat delivers about 120-200 joules to a small area and the inner layer helps to cushion the blow. On the other hand, when an enforcement officer shoves a person, the protective gear outer rigid layer may injure the person since the outer layer is not padded.

Generally, different sized users need different sized protective gear to match their size. Accordingly, law enforcement organizations are generally required to store many sized gear to match the needs of all users. It would thus be desirable to have an adjustable gear, to reduce the number of different sizes required.

SUMMARY OF THE DISCLOSURE

An aspect of an embodiment of the disclosure, relates to a deflection element that includes an upper arc and a lower arc, the upper arc having a smaller radius than the lower arc. Each arc includes a solid but yet flexible layer and a padding layer on one side of the arc. Each arc is encased with a material layer and the upper arc is positioned on top of the lower arc and their respective encasements are connected together at the ends of the upper layer. Upon receiving a blow to the upper arc, the upper arc serves as a spring deflecting the direction of the blow to disperse at least partially sideways into the lower arc.

Another aspect of the disclosure relates to a protective suit, which includes protective units configured to protect various limbs of a user. Each protective unit includes one or more deflection elements to reduce the transfer of energy from blows to the body of the user of the protective suit. Optionally, the protective suit protects the user and also people that collide with the user.

There is thus provided according to an embodiment of the disclosure, a deflection element, comprising:

An upper arc; and

A lower arc;

Wherein each of the upper arc and the lower arc comprise:

a) A solid flexible are shaped layer;

b) A soft padding layer on an inner side of the arc;

c) A material forming an encasement around the solid arc shaped layer and the soft padding layer; and Wherein the encasement of the upper arc at each end is connected to the encasement of the lower arc with the inner side of the upper arc facing the lower arc.

In an embodiment of the disclosure, the upper arc and lower arc both curve in the same direction and the lower arc has a larger radius than the upper arc. Optionally, the lower arc has an essentially infinite radius. Alternatively, the upper arc and lower arc curve in opposite directions. In an embodiment of the disclosure, the deflection element further comprises:

A second upper arc that is placed on the upper arc and connected to the encasement of the lower arc in a similar manner as the upper arc;

Wherein the second upper arc is rotated relative to the upper arc.

Optionally, the second upper arc is positioned orthogonally relative to the upper arc. In an embodiment of the disclosure, multiple upper arcs are connected to a single lower arc. Optionally, the material encasement is abrasion resistant. Alternatively or additionally, the material encasement is fire resistant.

There is further provided according to an embodiment of the disclosure, a protective suit, comprising:

Multiple protection units to protect a user's body wherein each protection unit includes one or more deflection element as described above.

In an embodiment of the disclosure, the multiple protection units include a head protection unit configured to protect a user's head.

In an embodiment of the disclosure, the multiple protection units include an arm protection unit configured to protect the user's arm. Optionally, the arm protection unit includes protection units configured to protect the user's shoulder, upper arm, elbow and forearm.

In an embodiment of the disclosure, the multiple protection units include a leg protection unit configured to protect the user's leg. Optionally, the leg protection unit includes protection units configured to protect the user's hip area, thigh, knee, lower leg and foot.

In an embodiment of the disclosure, the multiple protection units include a torso protection unit configured to protect the user's torso. Optionally, the torso protection unit includes protection units configured to protect the user's chest, back, left side and right side. In an embodiment of the disclosure, the torso protection units include pockets configured to accommodate bulletproof plates.

BRIEF DESCRIPTION OF THE DRAWINGS

The present disclosure will be understood and better appreciated from the following detailed description taken in conjunction with the drawings. Identical structures, elements or parts, which appear in more than one figure, are generally labeled with the same or similar number in all the figures in which they appear, wherein.

DETAILED DESCRIPTION

Figure 1A:
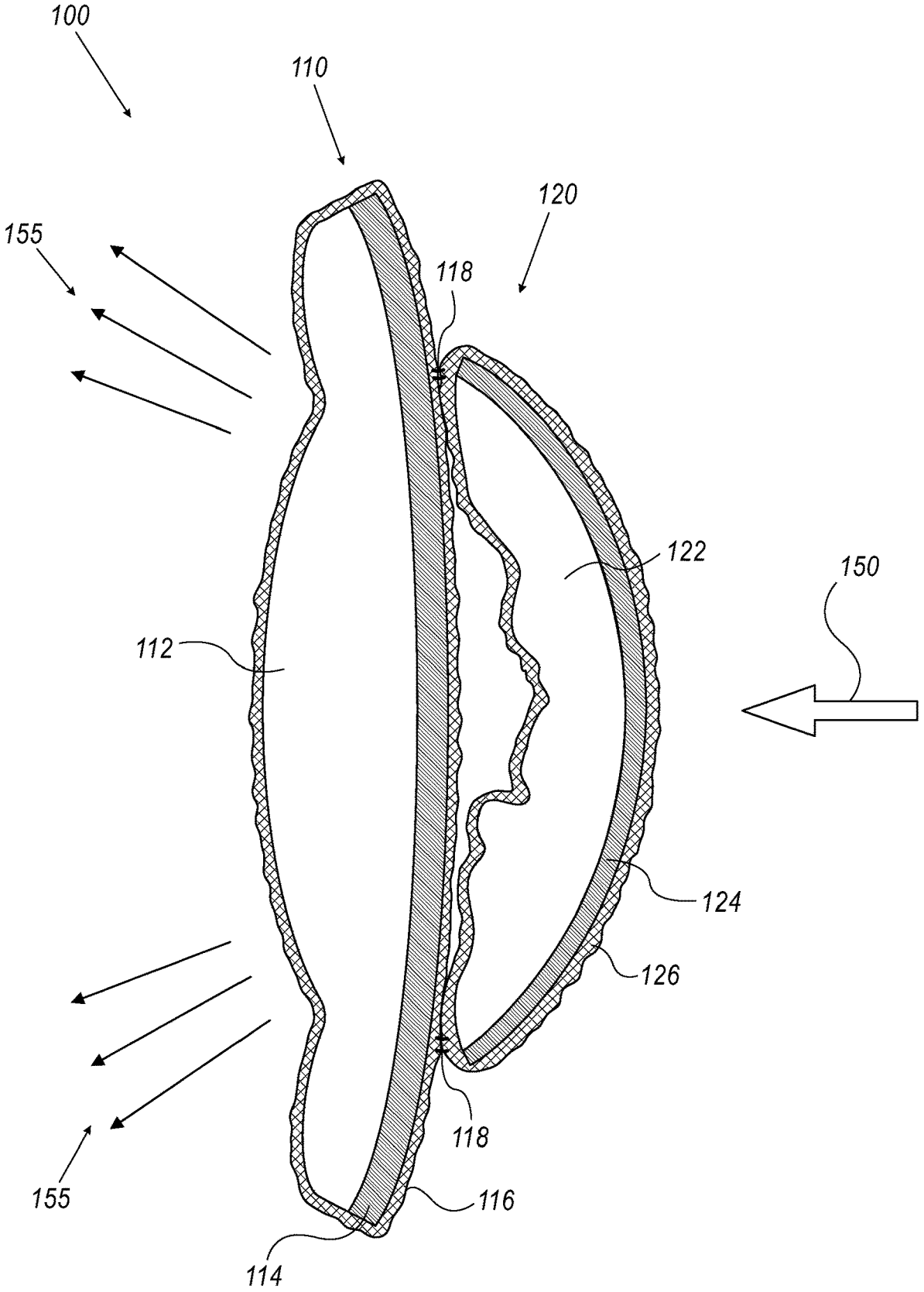
FIG. 1A is a schematic illustration of a side view of a deflection element, according to an embodiment of the disclosure.

FIG. 1A is a schematic illustration of a side view of a deflection element 100, according to an embodiment of the disclosure. In an embodiment of the disclosure, deflection element 100 includes two arcs (110, 120) that are connected together. A lower arc 110 having a larger radius and an upper arc 120 having a smaller radius. Each arc (110, 120) includes a solid flexible layer (114, 124) coupled to a soft padding material (112, 122) on the inner side of the arc (facing the center of the circle defined by the arc). Each arc (110, 120) with its solid flexible layer (114, 124) and respective soft padding material (112, 122) is enclosed by a thin enclosure layer (or encasement) (116, 126) surrounding the arc (110, 120). The enclosure layer (116, 126) is generally flexible or elastic to enable sideway motion of the ends of the upper arc 120 when applying a force 150 on the upper arc 120. Optionally, the upper arc 120 is attached to the lower arc 110 to deflect incoming forces 150. Optionally, when the upper arc 120 receives a blow it responds like a spring to deflect the energy of the blow by dispersing at least part of the energy of the blow sideways into the lower arc 110.

Figure 1B:
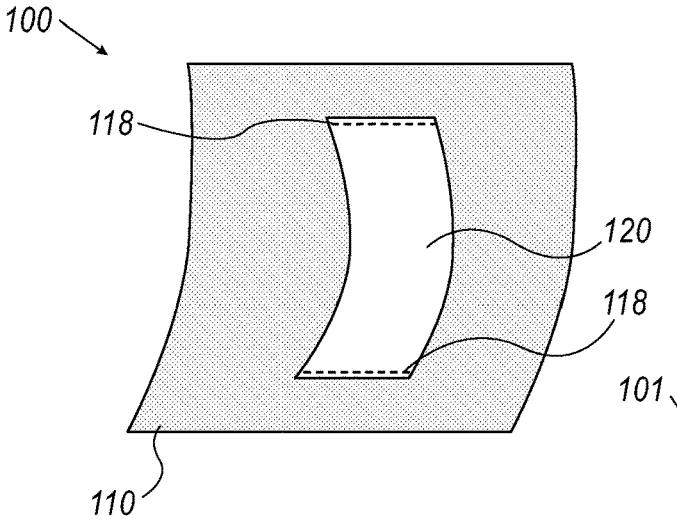
FIG. 1B is a schematic illustration of a top view of a deflection element, according to an embodiment of the disclosure.
Figure 1C:
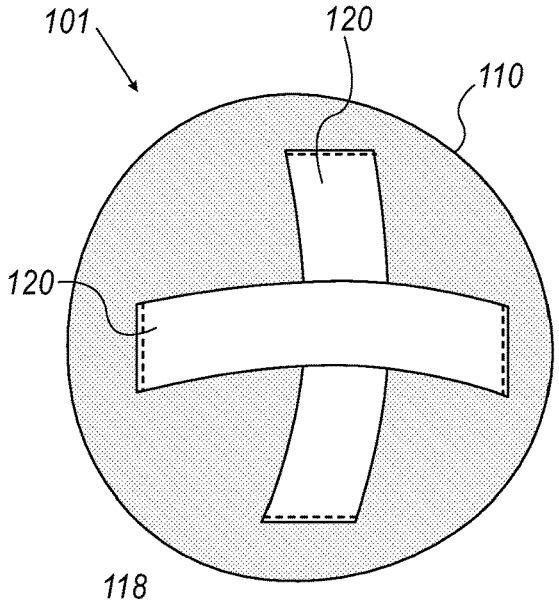
FIG. 1C is a schematic illustration of a top view of a two dimensional deflection element, according to an embodiment of the disclosure.
Figure 1D:
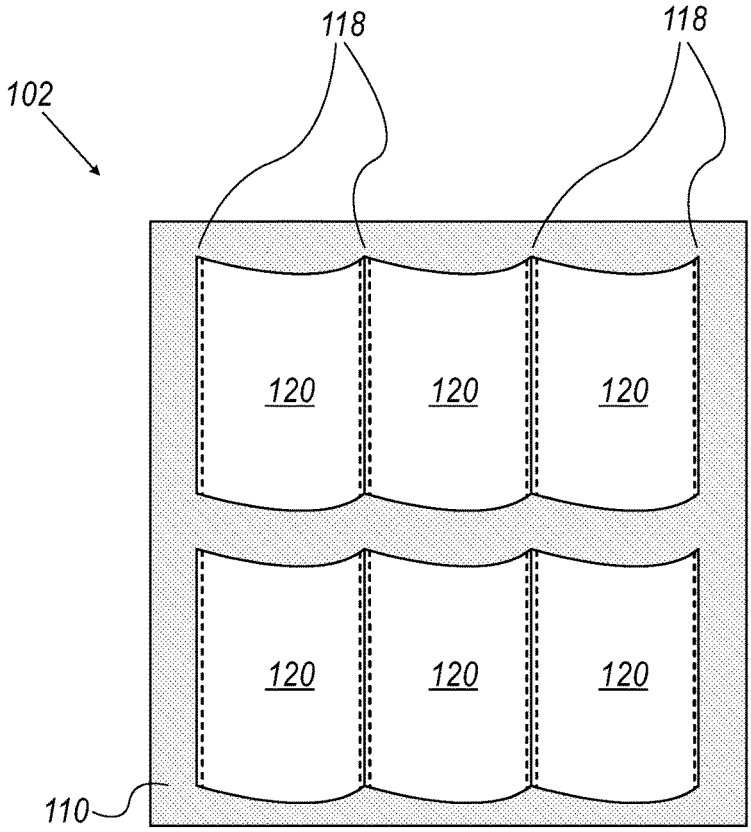
FIG. 1D is a schematic illustration of a top view of an alternative deflection element with multiple arcs, according to an embodiment of the disclosure.
Figure 1E:
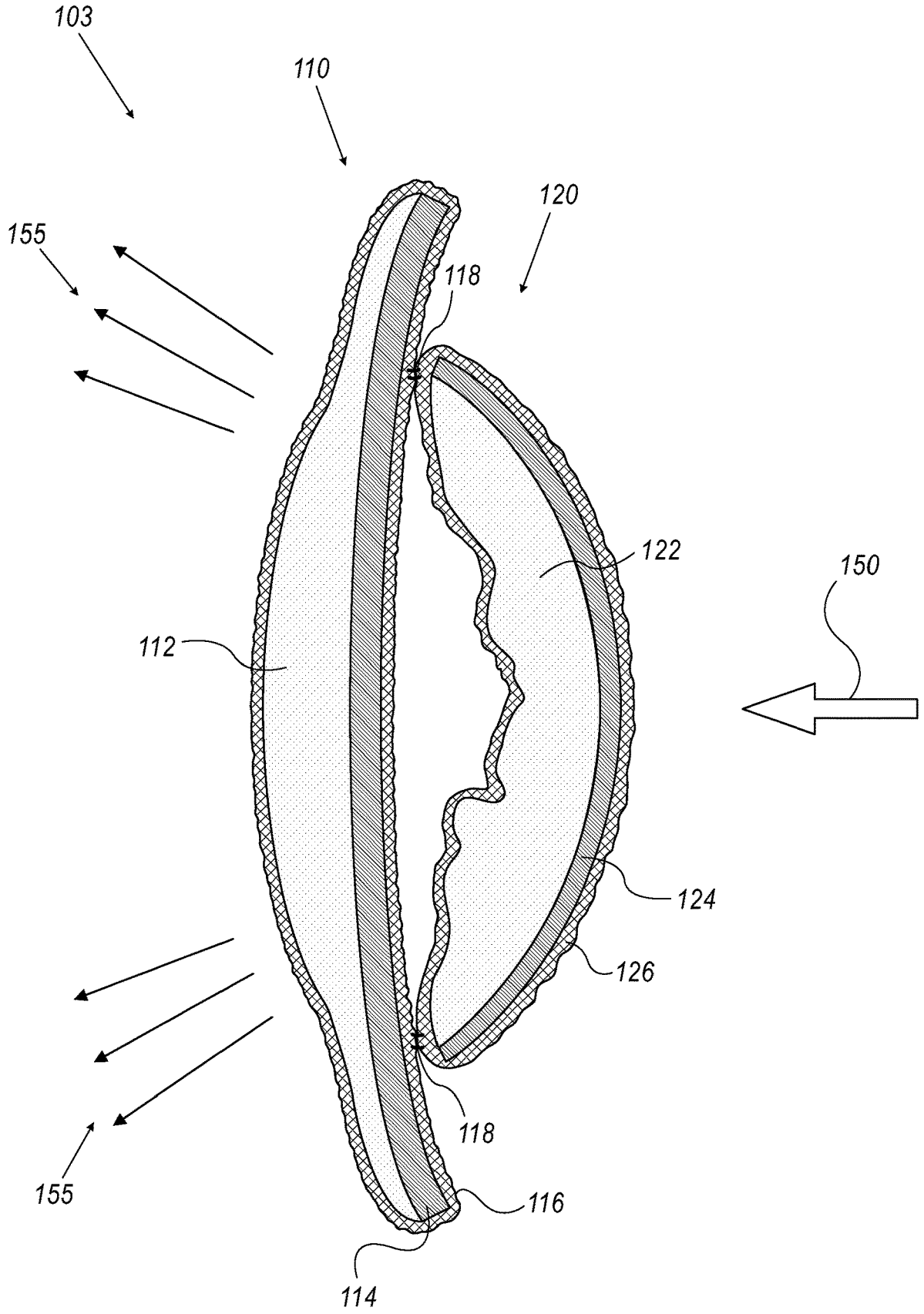
FIG. 1E is a schematic illustration of an alternative deflection element, according to an embodiment of the disclosure.
Figure 1F:
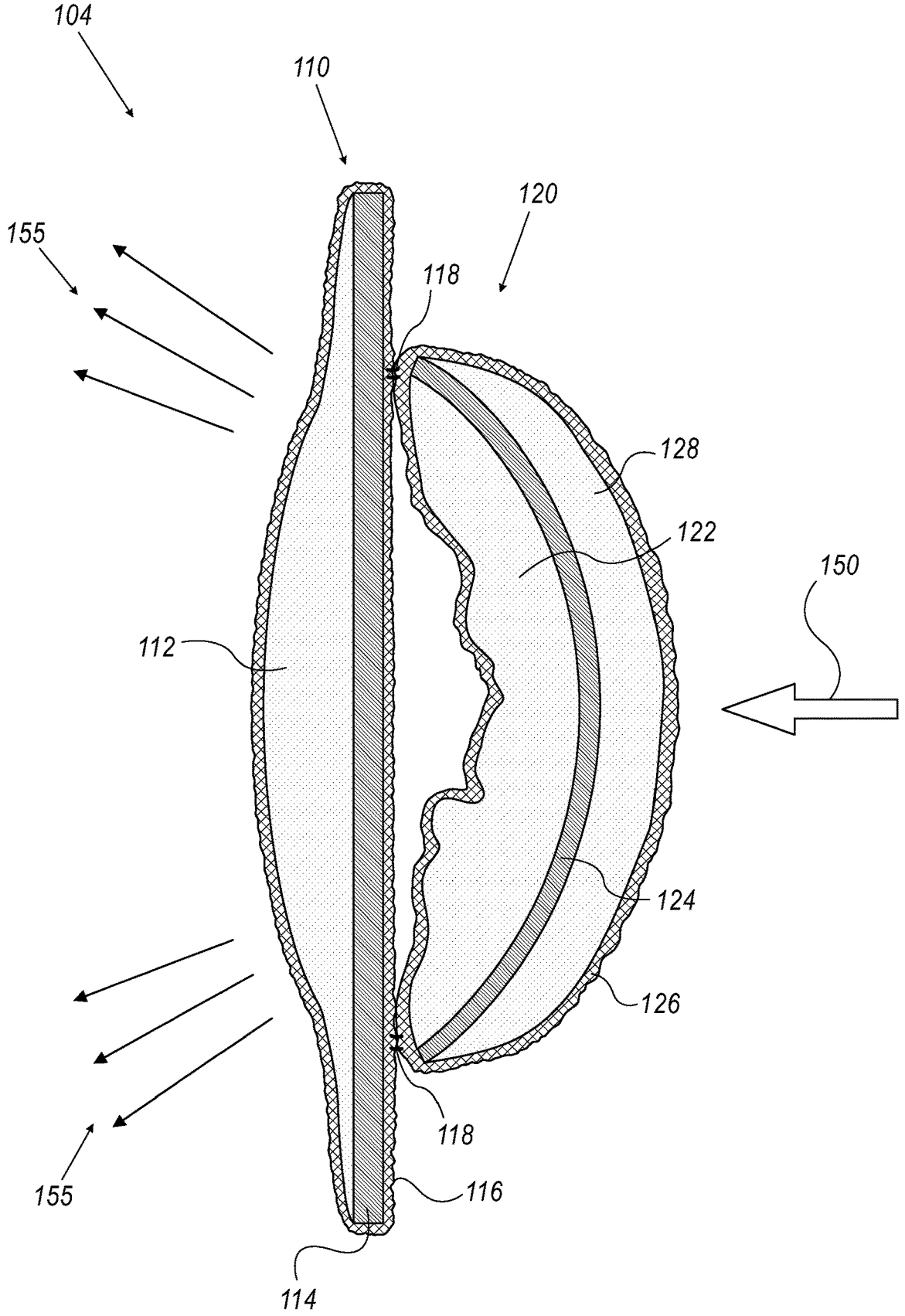
FIG. 1F is a schematic illustration of a further alternative deflection element, according to an embodiment of the disclosure.
Figure 1G:
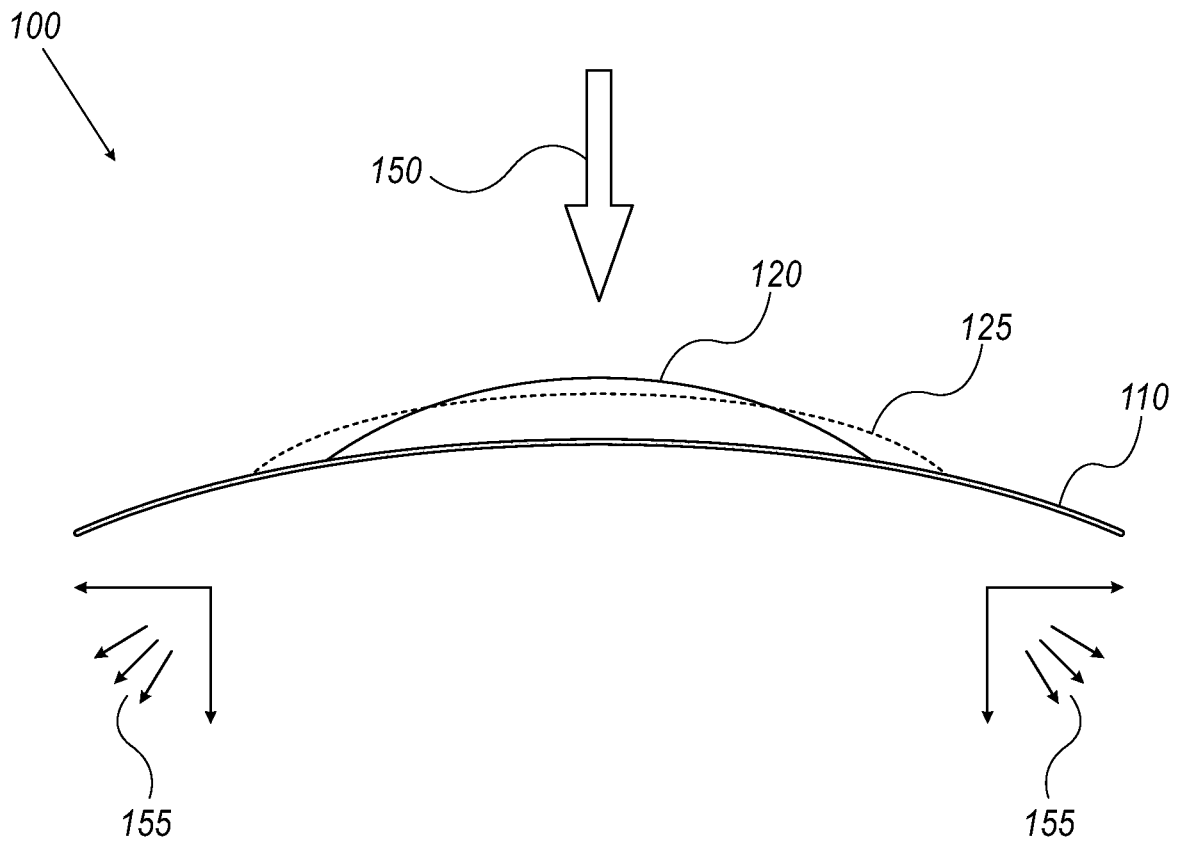
FIG. 1G is a schematic illustration of an effect of a force on a deflection element, according to an embodiment of the disclosure.

FIG. 1G is a schematic illustration of an effect of a force 150 on a deflection element, according to an embodiment of the disclosure. As shown in FIG. 1G the upper arc 120 presses against the lower arc 110 and is deformed by widening the upper arc 120 as shown by depressed are 125 in dotted lines. Thus upper arc 120 deflects the direction of some of the force from being directed downward to be directed sideways resulting in a deflected force 155 (with a sideways component and a downward component). Optionally, the lower arc 110 may also be deformed sideways by the force 150.

In an embodiment of the disclosure, the solid flexible layer (114, 124) of the arcs (110, 120) are made from a solid high density polyethylene (HDPE) sheet or other solid flexible material. Optionally, the width of the sheet is selected to be between about 0.8 to 1.5 mm. The padding material (112, 122) may be a foamed polyethylene sponge like material and the enclosure layer (116, 126) may be a material such as Cordura 1000 or other fabrics or nylon. Optionally, the padding material (112, 122) is a closed cell foamed polyurethane (e.g. Palziv) with a width of between about 5 to 10 mm. The length of the upper arc 120 is generally between 5 cm to 15 cm and the length of the lower arc 110 is generally about 10 cm to 40 cm depending on where it is used, for example on which part of a user's body it will be used to protect as described below.

In an embodiment of the disclosure, the upper arc 120 is attached with connections 118 to the lower arc 110. For example, the connection 118 may be implemented by sewing together the enclosure layers (116, 126), using an adhesive, using hook and loop fasteners (e.g. Velcro) or by heat attachment. Optionally, the enclosure layer is made from a material that is abrasion resistant and/or fire resistant.

In an embodiment of the disclosure, deflection element 100 is configured so that energy of a force 150 applied to the upper arc 120 is deflected essentially sideways by deflection element 100, for example as shown in FIG. 1A and FIG. 1G by the resulting forces 155. In some embodiments of the disclosure, deflection element 100 is configured so that an object placed under the lower arc 110 receives less than half of the force applied to the upper arc 120.

FIG. 1B is a schematic illustration of a top view of deflection element 100, according to an embodiment of the disclosure. Deflection element 100 is formed by a single elongated upper arc 120. However, the deflection element 100 may take other forms, for example as shown in FIG. 1C as deflection element 101. Optionally, deflection element 101 may have two upper arcs 120 that meet at the center of the arc or off-center. In some embodiments of the disclosure, there may be one or more upper arcs 120 in one direction and one or more upper arcs 120 in another direction. Optionally, the two upper arcs 120 may cross each other orthogonally or form other angles. As a result, deflection element 101 may deflect forces in four directions (e.g. north, south, east, and west) or other directions instead of in two directions as with deflection element 100.

In some embodiments of the disclosure, two or more upper arcs 120 are attached independently (e.g. not crossing each other) to a single lower arc 110 forming a deflection element 102 e.g. as shown in FIG. 1D. Optionally, deflection element 102 may be used to cover large areas, for example as part of vest 240 to protect the user's torso as shown below in FIG. 6A.

In an embodiment of the disclosure, lower arc 110 may have an essentially infinite radius (e.g. a flat or essentially flat surface instead of a curved surface, see deflection element 104 in FIG. 1F)). Alternatively or additionally, the lower arc 110 may curve in the opposite direction as the upper arc 120 to form an alternative deflection element 103 (e.g. like a clam shell) as shown in FIG. 1E. Optionally, the shape of lower arc 110 is selected based on its intended use to match the surface on which the deflection element 100 is to be deployed. For example when protecting a user's arm or leg, deflection element 100 will typically be used. In contrast when used within a helmet, deflection element 101 (with crossing arcs 120) or deflection element 103 (with a clam shape (FIG. 1E)) may be used to match the curvature of the helmet. Alternatively a combination of deflection elements 100, 101, 102, 103 and 104 may be used to match the deployment surface.

In some embodiments of the disclosure, the deflection elements (100, 101, 102, 103 or 104) may include padding material 128 (FIG. 1F-like 112, 122) also on the outer side of the upper arc 120 and not only on the inner side of the upper arc 120 to protect people that collide with the user of the protection suit 200.

Figure 1H:
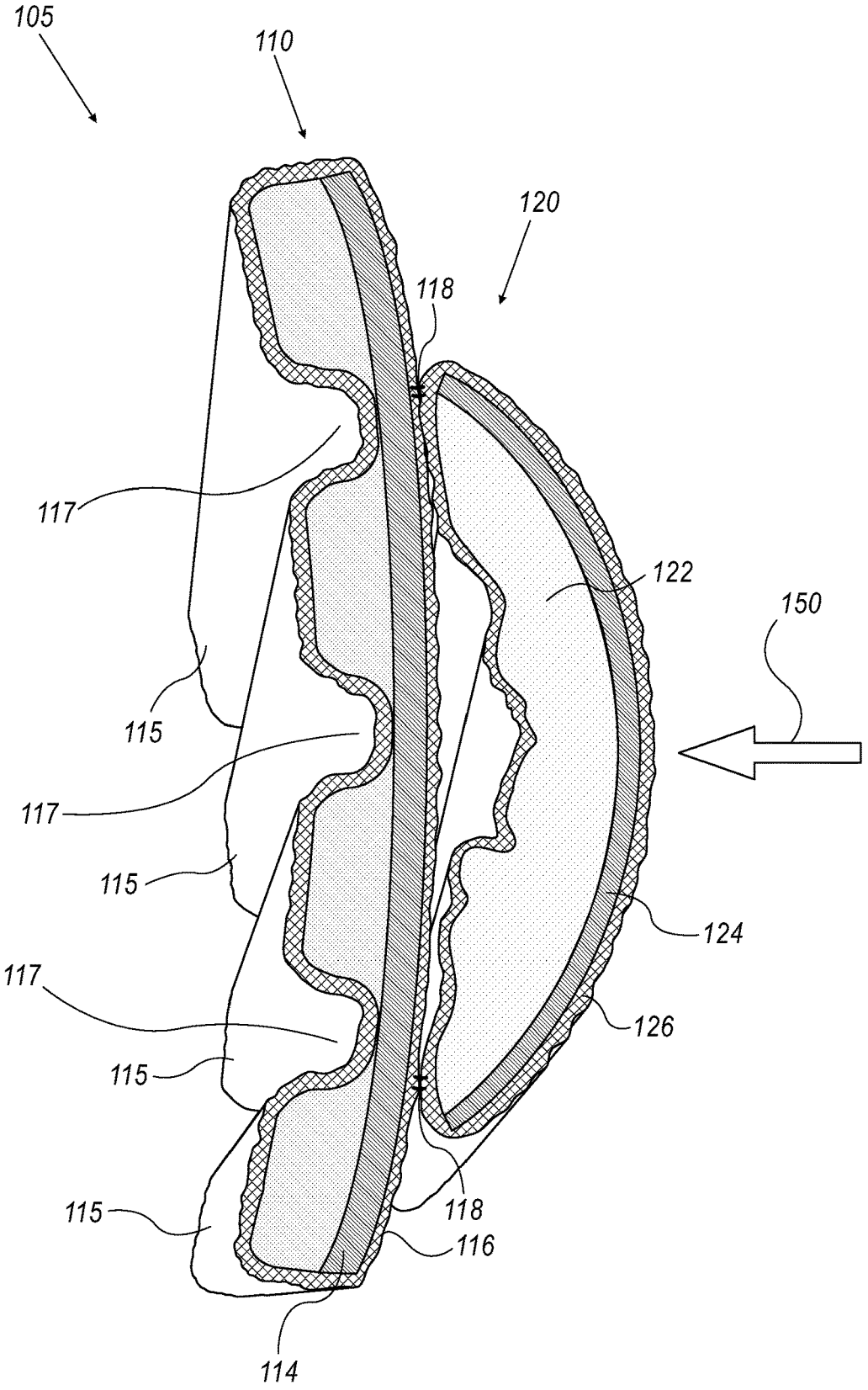
FIG. 1H is a schematic illustration of a side perspective view of an alternative deflection element, according to an embodiment of the disclosure.

FIG. 1H is a schematic illustration of a side perspective view of an alternative deflection element 105, according to an embodiment of the disclosure. Deflection element 105 is similar to deflection elements 100, 101, 102, 103 and 104 except that the padding material 112 of the lower arc 110 is formed as multiple independent elongated strips 115 with gaps 117 between the strips 115. This form enhances absorption of blows, since each strip can expand sideways independently into the gaps 117 when receiving a blow. Optionally, the strips 115 are essentially parallel to each other. Alternatively, they may be non-parallel. In some embodiments of the disclosure, the width of some or all of the strips 115 are the same. Optionally, the width of some or all of the gaps 117 are the same and may match the width of the strips 115. Alternatively, the center strips 115 may be wider than the strips 115 on the sides and/or the center gaps 117 may be narrower than the gaps 117 on the sides. In some embodiments of the disclosure, the elongated strips 115 have gaps also along the elongated axis of the strips 115. Optionally, the length of the strips 115 may differ depending on the shape of flexible layer 114, for example the length may be the same for a rectangular or square flexible layer 114 and may differ for a circular or ellipse flexible layer.

In an embodiment of the disclosure, the strips 115 are adhesively attached to the solid flexible layer 114. Alternatively, the strips 115 are attached with ropes or hook and loop fasteners (Velcro) so that their position may be adjusted. Further alternatively, the strips may be held in place by enclosure 116, which tightly encloses lower arc 110.

Figure 2:
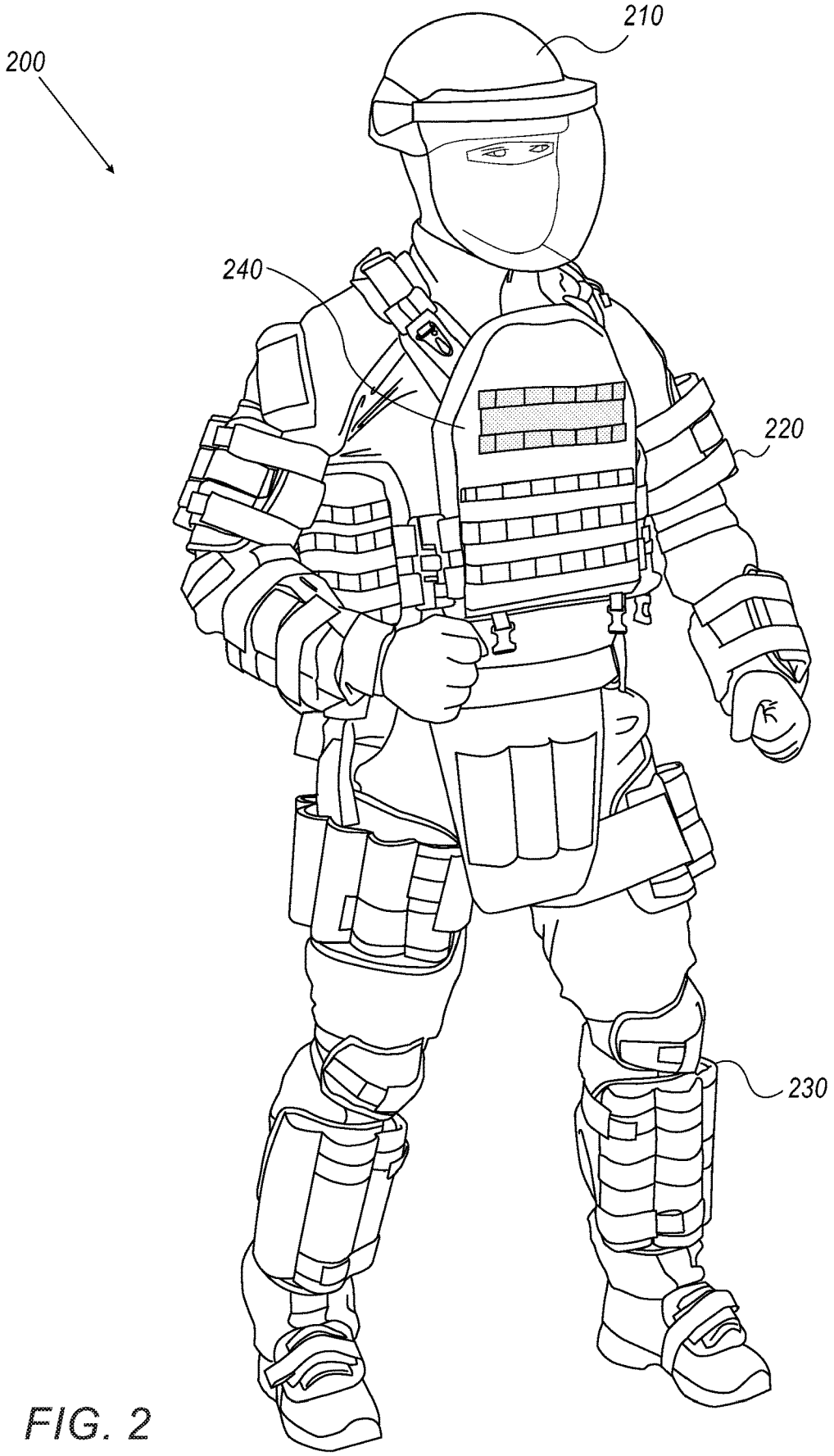
FIG. 2 is a schematic illustration of a protective suit, according to an embodiment of the disclosure.

FIG. 2 is a schematic illustration of a protective suit 200, according to an embodiment of the disclosure. Optionally, protective suit 200 comprises one or more protection units, which each include deflection elements 100 (or 101, 102, 103, 104) to protect the user from impacts applied to the protective suit 200, for example caused by bullets, knives, rocks, sticks or other elements.

In an embodiment of the disclosure, protective suit 200 includes 4 main parts:

1. A head protection unit 210 to protect the user's head;
2. An arm protection unit 220 to protect the user's arms;
3. A leg protection unit 230 to protect the user's legs; and
4. A torso protection unit 240 to protect the user's torso.

Optionally, each of the parts includes deflection elements 100, 101, 102, 103 or 104 to enhance user protection. Optionally, protective suit 200 may include additional parts to protect other parts. In some embodiments of the disclosure, each protection unit (210, 220, 230 and 240) may be divided into smaller section to be better adapted to fit the user. In an embodiment of the disclosure, each protection unit includes one or more deflection elements (100, 101, 102, 103 or 104).

Figure 3:
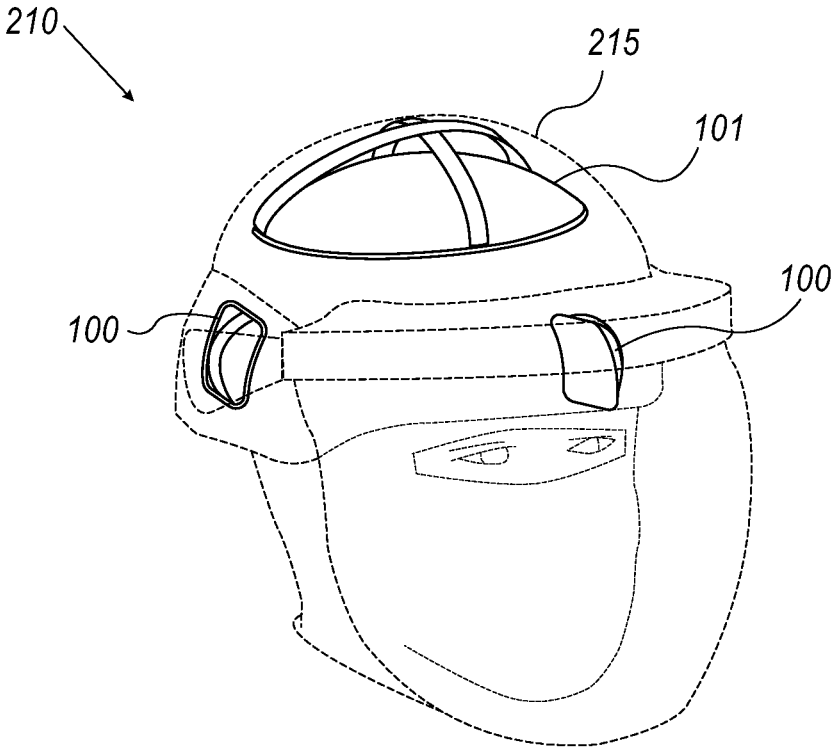
FIG. 3 is a schematic transparent view of a head protection unit of a protective suit, according to an embodiment of the disclosure.

FIG. 3 is a schematic transparent view of a head protection unit 210 of a protective suit 200, according to an embodiment of the disclosure. In an embodiment of the disclosure, the head protection unit 210 comprises a helmet 215 and one or more deflection elements (100, 101, 102, 103 or 104) placed within helmet 215 to deflect forces exerted on the helmet 215 and protect the user's head.

Figure 4:
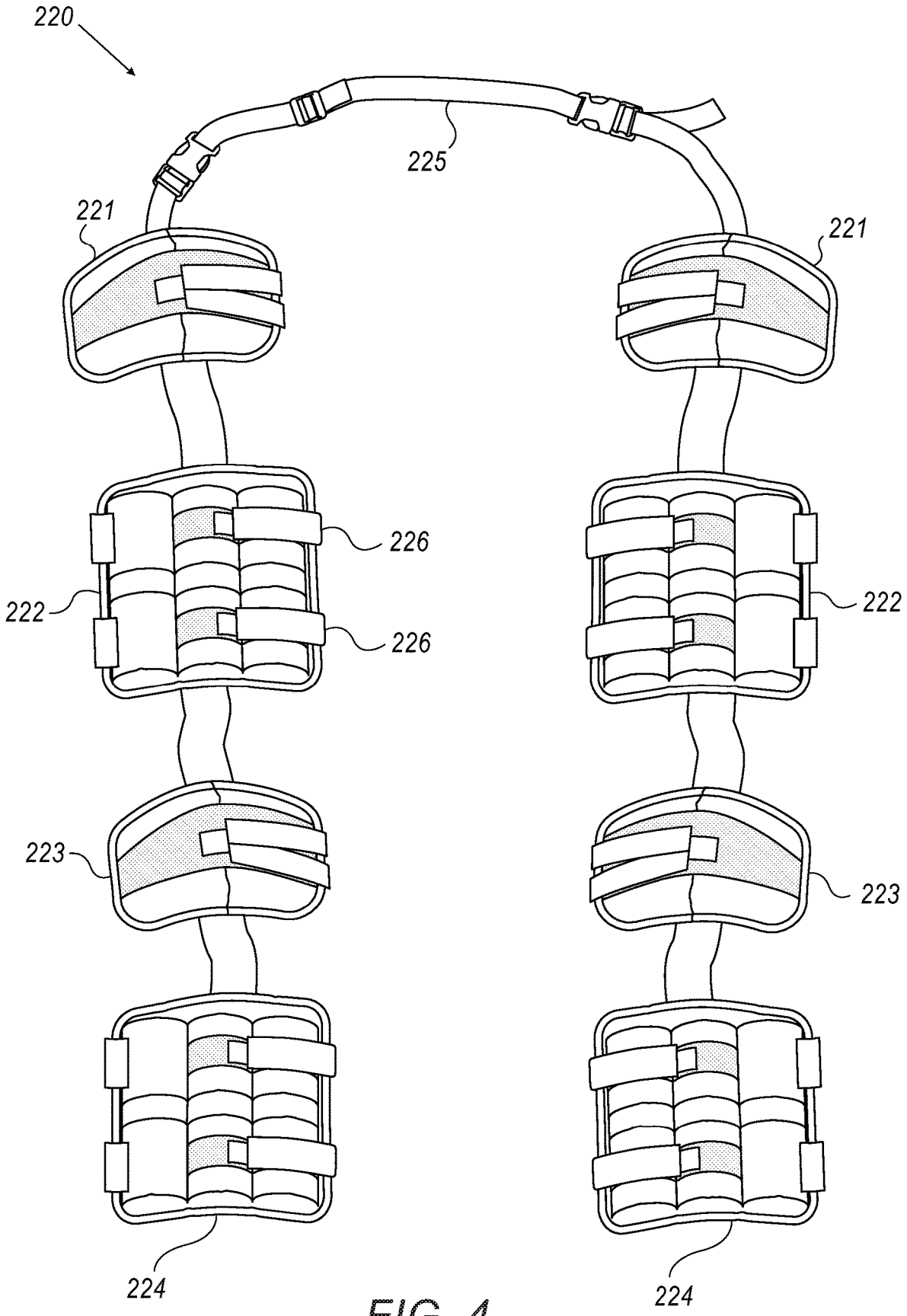
FIG. 4 is a schematic illustration of an arm protection unit of a protective suit, according to an embodiment of the disclosure.

FIG. 4 is a schematic illustration of an arm protection unit 220 of protective suit 200, according to an embodiment of the disclosure. In an embodiment of the disclosure, arm protection 220 includes multiple units, each comprising one or more deflection elements for each arm: one to protect the shoulders 221, the upper arm 222, the elbow 223 and one to protect the forearm 224. Optionally, the multiple units are connected together with adjustable straps 225, which can be adjusted according to the size of the user so that each unit is positioned correctly. In an embodiment of the disclosure, the unit protecting the shoulder 221 includes a single deflection element 100, the unit protecting the upper arm 221 includes a deflection element 102 with two or more upper arcs 120 connected to a single lower arc 110. In a similar manner the unit protecting the forearm 224 may also include a deflection element 102 with two or more upper arcs 120 connected to a single lower arc 110 or multiple deflection elements 100. In contrast, the unit protecting the elbow 223 includes a deflection element 100 with a single upper arc 120 connected to a single lower arc 110. In some embodiments of the disclosure, the multiple units include straps 226 to attach each unit to a respective limb. Optionally, straps 226 may be in the form of Velcro (e.g. Hook and loop) or include snaps, interlocking plastic buckles or other types of fasteners.

Figure 5A:
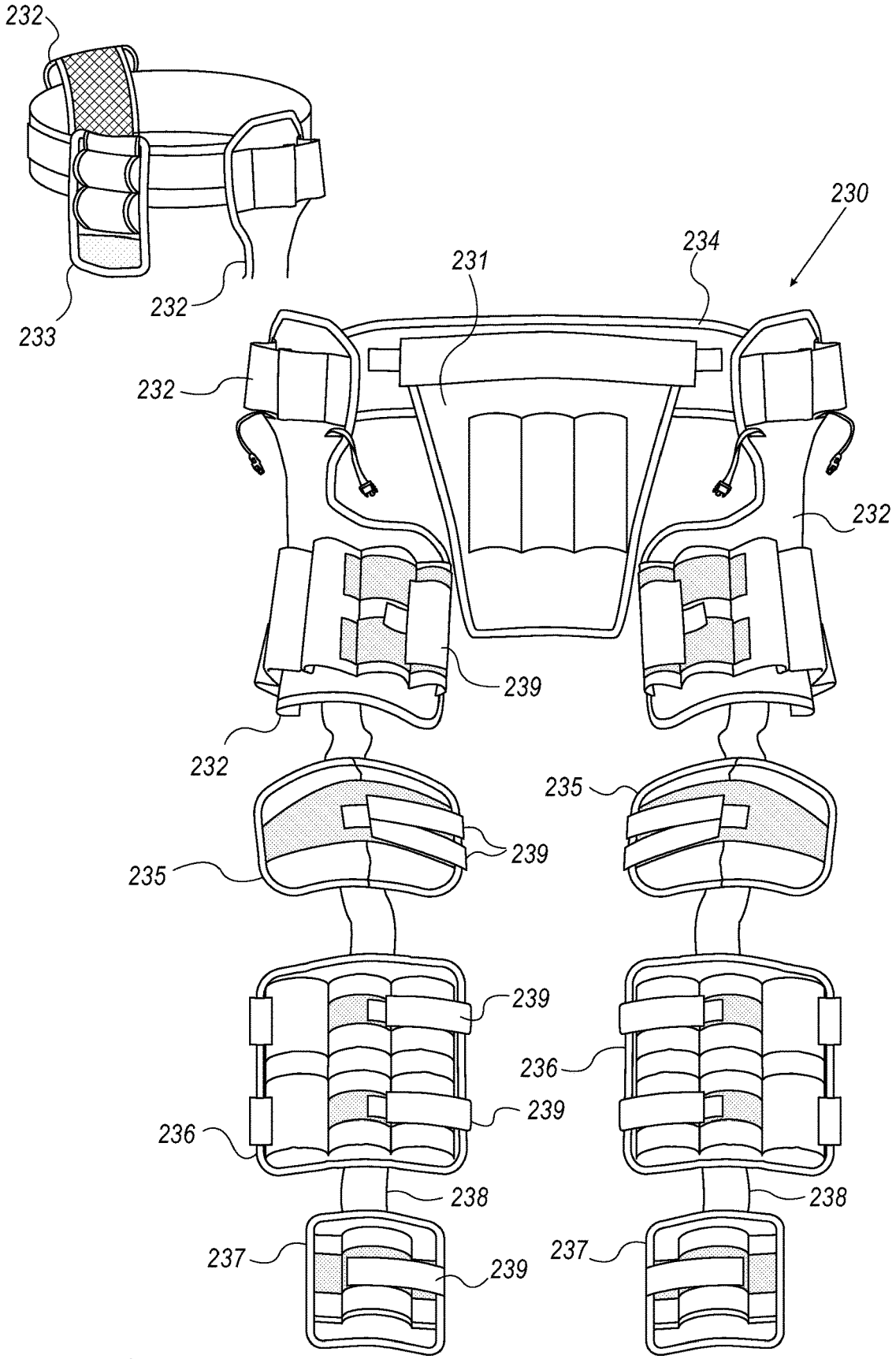
FIG. 5A is a schematic illustration of a leg protection unit of a protective suit, according to an embodiment of the disclosure.
Figure 5B:
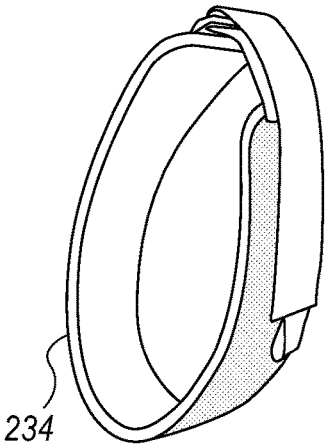
FIG. 5B is a schematic illustration of a belt of a leg protection unit, according to an embodiment of the disclosure.
Figure 5C:
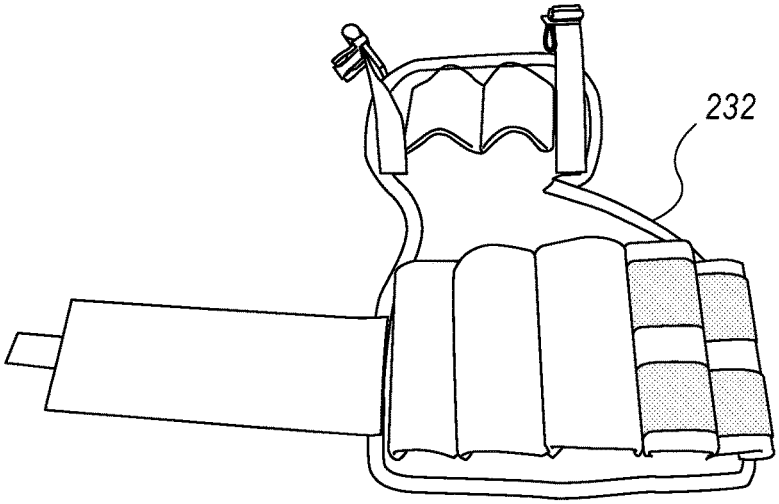
FIG. 5C is a schematic illustration of a thigh protection of a leg protection unit, according to an embodiment of the disclosure.
Figure 5E:
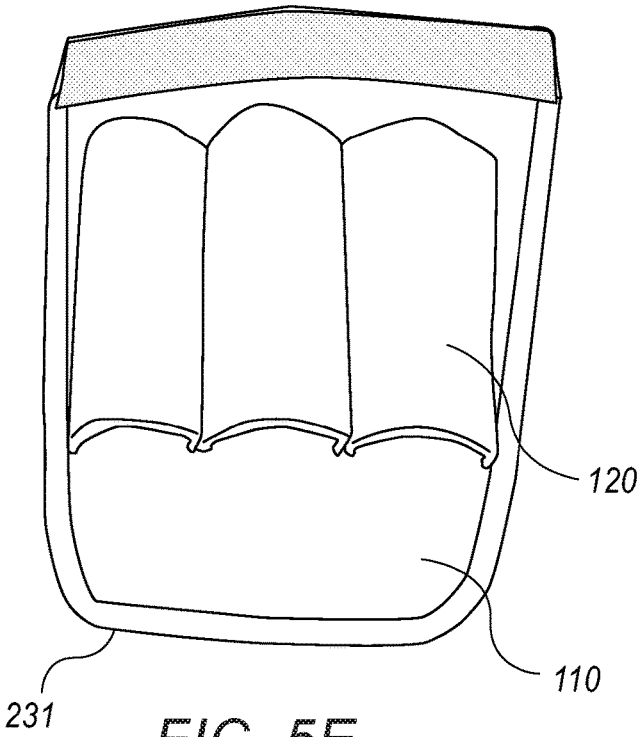
FIG. 5E is a schematic illustration of a central protection unit of a protective suit, according to an embodiment of the disclosure.
Figure 5D:
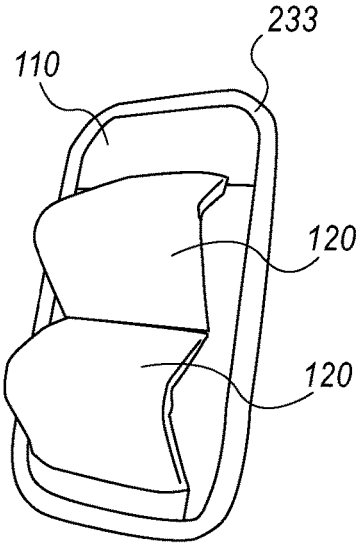
FIG. 5D is a schematic illustration of a rear protection of a protective suit, according to an embodiment of the disclosure.

FIG. 5A is a schematic illustration of a leg protection unit 230 of protective suit 200, according to an embodiment of the disclosure. In an embodiment of the disclosure, leg protection 230 includes multiple units, each comprising one or more deflection elements (100, 101, 102, 103 or 104) to protect the user. Optionally, the leg protection unit 230 includes a central part to protect the pelvis of the user. The central part may include a belt 234, which holds a groin protection unit 231 (FIG. 5E), a left and right thigh protection unit 232 (FIG. 5C) and a rear protection unit 233 (FIG. 5D) to protect the user's tailbone or spine. In an embodiment of the disclosure, the leg protection unit 230 further includes a knee protection unit 235, a calf and/or lower leg protection unit 236 and a foot protection unit 237. Optionally, the protection units (232 (thigh). 235 (knee), 236 (lower leg) and 237 (foot)) are provided for the user's left leg and right leg. Optionally, the protection units (232, 235, 236 and 237) are coupled together with an adjustable strap 238 so that the position of each protection unit (232, 235, 236 and 237) can be adjusted to fit the size of the user.

In an embodiment of the disclosure, each unit includes one or more deflection elements (100, 101, 102, 103 or 104). For example, the unit protecting the thigh 232 may include a deflection element 102 with two or more upper arcs 120 connected to a single lower arc 110. In a similar manner the unit protecting the lower leg 236 may also include a deflection element 102 with two or more upper arcs 120 connected to a single lower arc 110. In contrast the unit protecting the knee 235 and foot 237 may include a deflection element 100 with a single upper arc 120 connected to a single lower arc 110.

In an embodiment of the disclosure, each protection unit (232, 235, 236 and 237) includes straps 239 to attach the protection units (232, 235, 236 and 237) to the user's limbs. Optionally, straps 239 may be in the form of Velcro (e.g. Hook and loop) or include snaps, interlocking plastic buckles or other types of fasteners.

Figure 6A:
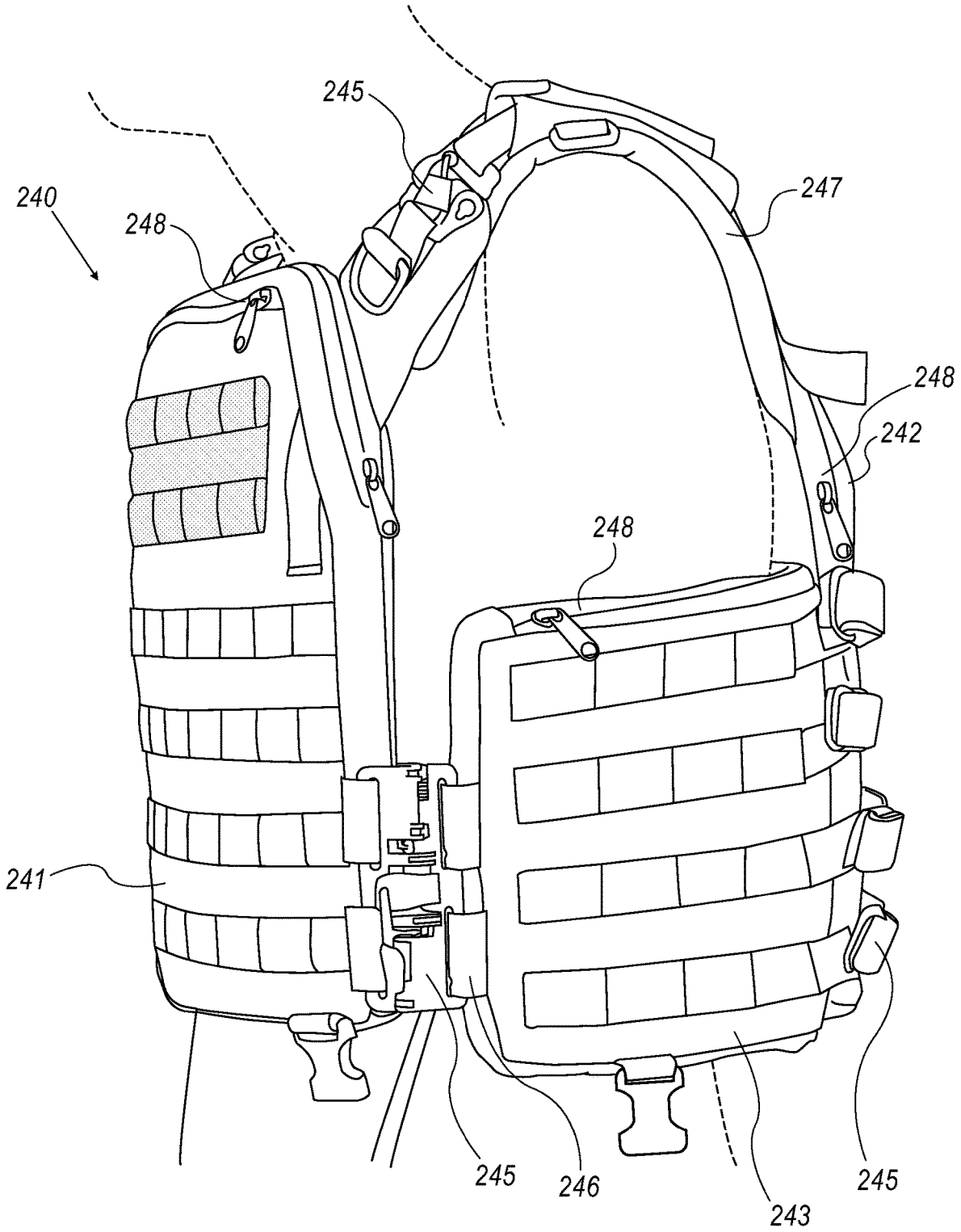
FIG. 6A is a schematic illustration of a torso protection unit of a protective suit, according to an embodiment of the disclosure.

FIG. 6A is a schematic illustration of a torso protection unit 240 of a protective suit 200, according to an embodiment of the disclosure. Optionally, torso protection unit 240 is referred to as vest 240, comprising: a front vest unit 241 (FIG. 6B), a back vest unit 242 (FIG. 6C), and right and left side vest units 243 (FIG. 6D). The vest units (241, 242, 243) are assembled together to form vest 240 that is configured to enclose around the torso of the user. Optionally, the four units (241, 242, 243 right, 243 left) are connected together with connectors 245 and/or straps 246 that enable quick release of the units (241, 242, 243 right, 243 left). In an embodiment of the disclosure, the vest 240 further includes additional straps 247 that are adjustable to connect the front vest unit 241 to the back vest unit 242 and to adjust the side units 243 over the user's shoulders to keep vest 240 in position on the user's body. Optionally, connectors 245 are quick release fasteners to quickly assemble or release the vest 240 from the user's body.

In an embodiment of the disclosure, the torso unit 240 includes one or more pockets 248 to insert bullet proof plates (e.g. rigid armored plates) in the front vest 241, side vests 243 and/or back vest 242.

Figure 6B:
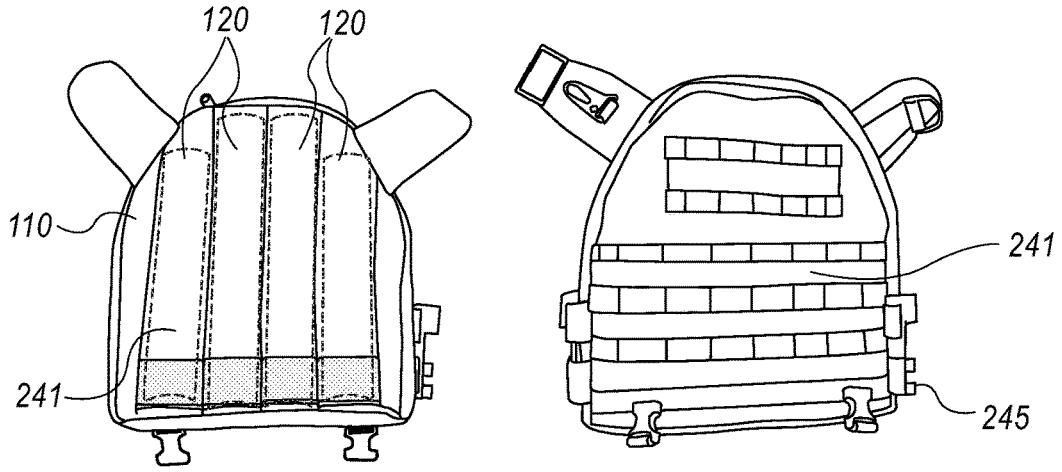
FIG. 6B is a schematic illustration of a front view and back view of a front torso protection unit of a protective suit, according to an embodiment of the disclosure.

FIG. 6B is a schematic illustration of a front view and back view of front vest unit 241 of protective suit 200, according to an embodiment of the disclosure. Optionally, the front vest unit 241 includes a deflection element 102 having a large single lower arc 110 and a few rows of upper arcs 120. Optionally, front vest unit 241 can be positioned so that the upper arcs 120 face the user's chest or they can be positioned to face away from the user's chest. Additionally, the upper arcs 120 may be behind the pockets 248 or in front of the pockets 248.

Figure 6C:
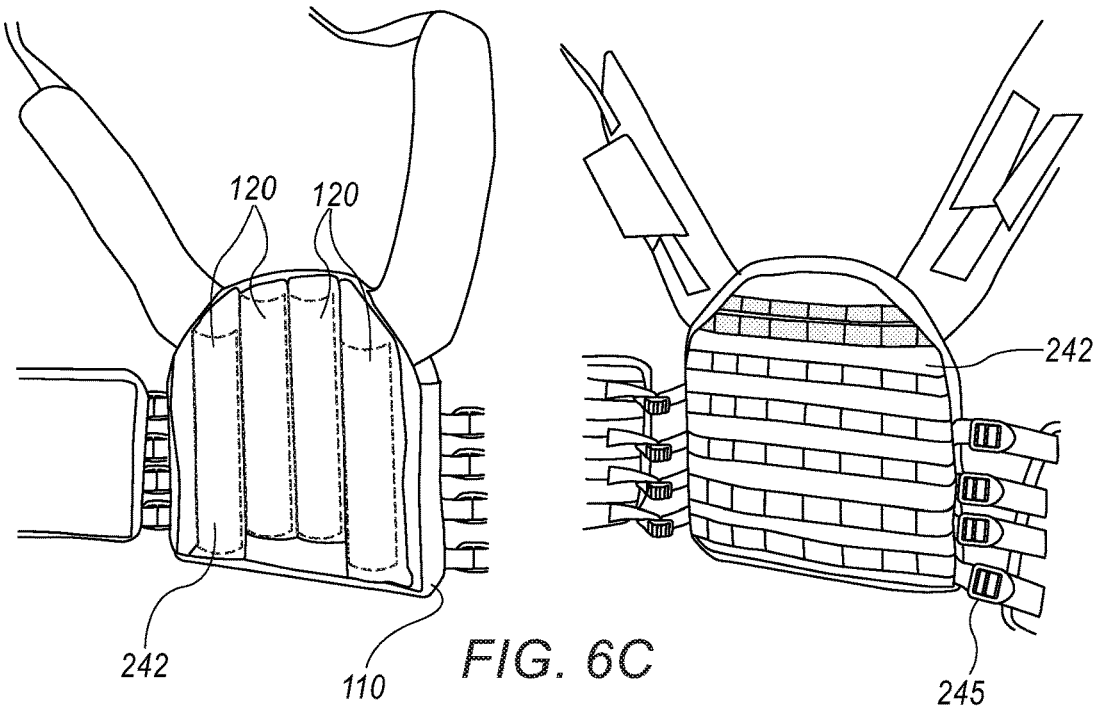
FIG. 6C is a schematic illustration of a front view and back view of a back torso protection unit of a protective suit, according to an embodiment of the disclosure.
Figure 6D:
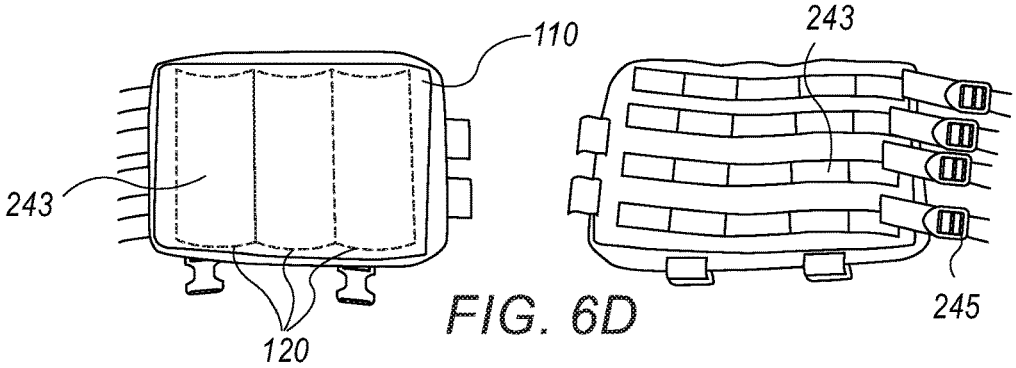
FIG. 6D is a schematic illustration of a front view and back view of a side torso protection unit of a protective suit, according to an embodiment of the disclosure.

FIG. 6C is a schematic illustration of a front view and back view of back vest unit 242 of a protective suit, according to an embodiment of the disclosure. Optionally, the back vest unit 242 includes a deflection element 102 having a large single lower arc 110 and a few rows of upper arcs 120. Optionally, back vest unit 242 can be positioned so that the upper arcs 120 face the user's back or they can be positioned to face away from the user's back. Additionally, the upper arcs 120 may be behind the pockets 248 or in front of the pockets 248

FIG. 6D is a schematic illustration of a front view and back view of a side vest unit 243 of a protective suit, according to an embodiment of the disclosure. Optionally, the side vest units 243 right and 243 left include a deflection element 102 having a large single lower arc 110 and a few rows of upper arcs 120. Optionally, side vest units 243 can be positioned so that the upper arcs 120 face the user's body or they can be positioned to face away from the user's body. Additionally, the upper arcs 120 may be behind the pockets 248 or in front of the pockets 248.

In some embodiments of the disclosure, the form of the protective suit 200 may differ, for example including additional units or less units and wherein each unit may include one or more deflection elements (100, 101, 102, 103 or 104) of various types as described above.

It should be appreciated that the above-described methods and apparatus may be varied in many ways, including omitting or adding elements or steps, changing the order of steps and the type of devices used. It should be appreciated that different features may be combined in different ways. In particular, not all the features shown above in a particular embodiment are necessary in every embodiment of the disclosure. Further combinations of the above features are also considered to be within the scope of some embodiments of the disclosure.

It will be appreciated by persons skilled in the art that the present invention is not limited to what has been particularly shown and described hereinabove. Rather the scope of the present invention is defined only by the claims, which follow.

I claim:

1. A deflection element, comprising:

an upper arc; and a lower arc;

wherein each of the upper arc and the lower arc comprise:

a) a solid flexible arc shaped layer;

b) a soft padding layer on an inner side of the upper arc and on a matching side of the lower arc;

c) a material forming an encasement around the solid flexible arc shaped layer and the soft padding layer; and wherein the encasement of the upper arc at each end is connected to the encasement of the lower arc with the inner side of the upper arc facing the lower arc.

2. The deflection element of claim 1, wherein the upper arc and lower arc both curve in the same direction and the lower arc has a larger radius than the upper arc.

3. The deflection element of claim 1, wherein the lower arc has an essentially infinite radius.

4. The deflection element of claim 1, wherein the upper arc and lower arc curve in opposite directions.

5. The deflection element of claim 1, comprising:

a second upper arc that is placed on the upper arc and connected to the encasement of the lower arc in a similar manner as the upper arc;

wherein the second upper arc is rotated relative to the upper arc.

6. The deflection element of claim 5, wherein the second upper arc is positioned orthogonally relative to the upper arc.

7. The deflection element of claim 1, wherein multiple upper arcs are connected to a single lower arc.

8. The deflection element of claim 1, wherein the encasement is abrasion resistant.

9. The deflection element of claim 1, wherein the encasement is fire resistant.

10. The deflection element of claim 1, wherein the soft padding layer on the lower arc comprises multiple independent elongated strips with gaps between the strips.

11. The deflection element of claim 10, wherein the width of the elongated strips are all the same.

12. A protective suit, comprising:

multiple protection units to protect a user's body wherein each protection unit includes one or more deflection element as claimed in claim 1.

13. The protective suit of claim 12, wherein said multiple protection units include a head protection unit configured to protect a user's head.

14. The protective suit of claim 12, wherein said multiple protection units include an arm protection unit configured to protect a user's arm.

15. The protective suit of claim 14, wherein the arm protection unit includes protection units configured to protect a user's shoulder, upper arm, elbow and forearm.

16. The protective suit of claim 12, wherein said multiple protection units include a leg protection unit configured to protect a user's leg.

17. The protective suit of claim 16, wherein the leg protection unit includes protection units configured to protect a user's hip area, thigh, knee, lower leg and foot.

18. The protective suit of claim 12 wherein said multiple protection units include a torso protection unit configured to protect a user's torso.

19. The protective suit of claim 18, wherein the torso protection unit includes protection units configured to protect a user's chest, back, left side and right side.

20. The protective suit of claim 19 wherein the torso protection unit include pockets configured to accommodate bulletproof plates.

* * * * *